US007260916B2

(12) United States Patent
Sarnell et al.

(10) Patent No.: US 7,260,916 B2
(45) Date of Patent: Aug. 28, 2007

(54) DEVICE FOR FORMING A DISPLACEABLE WALL STRUCTURE

(75) Inventors: Johan Sarnell, Göteborg (SE); Åke Johansson, Kungsbacka (SE)

(73) Assignee: Global Financial (Advisors) Ltd., Gibralta (ES)

( * ) Notice: Subject to any disclaimer, the term of this patent is extended or adjusted under 35 U.S.C. 154(b) by 0 days.

(21) Appl. No.: 11/073,943

(22) Filed: Mar. 7, 2005

(65) Prior Publication Data

US 2005/0229512 A1 Oct. 20, 2005

Related U.S. Application Data

(63) Continuation of application No. PCT/SE03/001371, filed on Sep. 4, 2003.

(30) Foreign Application Priority Data

Sep. 6, 2002 (SE) ..... 0202668

(51) Int. Cl.
*E05D 15/06* (2006.01)

(52) U.S. Cl. ..... 49/409; 49/410; 49/127; 160/196.1; 52/243.1

(58) Field of Classification Search ..... 49/125, 49/126, 127, 128, 394, 409; 160/196.1; 52/243.1
See application file for complete search history.

(56) References Cited

U.S. PATENT DOCUMENTS 3,303,612 A * 2/1967 Baker ..... 49/127
3,810,330 A * 5/1974 Daggy ..... 49/127
5,058,321 A * 10/1991 Harbom et al. ..... 49/177
5,272,839 A * 12/1993 Karhu ..... 49/409
5,548,926 A 8/1996 Sjöholm
6,065,247 A * 5/2000 Sundvall ..... 49/258
6,301,833 B1 * 10/2001 Airikkala ..... 49/409
6,397,522 B1 * 6/2002 Nussbaum ..... 49/127
6,553,715 B1 * 4/2003 Lonnberg ..... 49/127
6,691,462 B2 * 2/2004 Oestermann ..... 49/213

FOREIGN PATENT DOCUMENTS

| | | |
|---|---|---|
| DE | 1 509 410 | 4/1962 |
| FR | 1.118.140 | 3/1956 |
| SE | 513 307 | 8/2000 |

* cited by examiner

*Primary Examiner*—Jerry Redman
(74) *Attorney, Agent, or Firm*—Gauthier & Connors LLP

(57) ABSTRACT

A device for forming a displaceable wall structure, comprising one or more building elements each provided with a first and a second arrangement for suspension of the building element from a support unit and for substantially horizontal movement of the building element forward and backward along the support unit. The first and the second suspension arrangements, when cooperating with the support unit, are arranged spaced from each other along the extension of the building element parallel to said substantially horizontal movement direction, and the building element includes another element for pivoting the building element about a substantially vertical pivot axis.

20 Claims, 7 Drawing Sheets

DEVICE FOR FORMING A DISPLACEABLE WALL STRUCTURE

Figure 1:
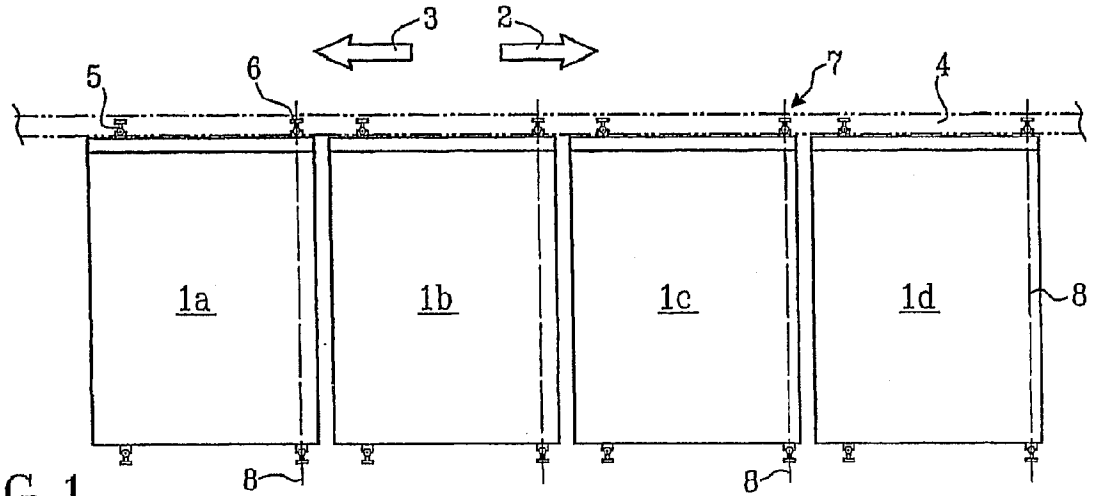

This is a continuation of copending application(s) International Application PCT/SE03/001371 filed on 04 Sep. 2003 and which designated the U.S.

THE FIELD OF INVENTION AND PRIOR ART

The present invention relates to a device for forming a displaceable wall structure and to a method for locking a building element.

The invention may be applied in several different displaceable wall structures having different numbers and types of building elements, and building elements of various materials, and therefore it is emphasized that although the invention will be described, such as an example, when being applied to such displaceable walls which for example are used for glazing balconies, terraces, verandas, etc, the invention is applicable to a larger technical field comprising wall structures in general where it is desirable to be able to move building elements for establishing a wall and moving the wall away, respectively, in a easy and safe way.

For forming walls intended for glazing balconies or similar, traditionally building elements in the shape of glass plates arranged on upper and lower guiding rails have been used. Such glass plates may be displaceable latterly in a way enabling them to overlap each other to a certain extent for the purpose of enabling the wall to be moved away for opening the glazed-in area when needed. However, a large drawback of this kind of walls is a low flexibility and just the fact that the possibility to open the glazed-in area by displacing the building elements is limited and dependent on for example the extension of the glass plates in the movement direction.

To solve this problem, wall structures having building elements which are not only horizontal displaceable along a support unit in the shape of a rail or similar, but also pivotable so that the building elements may be stacked against for example a side wall of a balcony by pivoting them about a vertical pivot axis, have been suggested. The building elements of such wall structures have a pivoting means for realizing the pivot motion which pivoting means cooperates with a locking mechanism for locking the pivoting means against horizontal movement in a predetermined position. When stacking the building elements thus, the respective building element is displaced to predetermined position, in which the pivoting means of the building element may be locked against horizontal movement by means of the locking mechanism, and thereafter the building element is pivoted away to the desired position.

Usually these wall structures are designed so that when the building element be pivoted about the vertical pivot axis one first of usually two suspension arrangements, such as a wheel and corresponding equipment, leaves the support unit and the pivoting means is arranged at the other suspension arrangement. The pivoting means and the locking mechanism work, however, in such a way that a certain smallest pivot motion of the building element is required to brought a part of the pivoting means to a position in which the locking mechanism is able to lock this part and thereby lock the building element in an upright position fixed in the horizontal direction during the remaining pivot motion.

For the purpose of trying to secure that the building element remains in an upright position, i.e. not being tilted relative to a horizontal line, and neither being moved in the horizontal direction during the initial stage of the pivot motion, before the locking mechanism is able to provide for locking the pivoting means, a rest member supporting the building element from below and from the side via the first suspension arrangement is frequently used.

However, it has been found out that these rest members which regularly are situated in one end of the building element, since the both suspension arrangements are situated in different ends of the building element for obtaining a distance as long as possible between these arrangements, have considerable drawbacks. One of the disadvantages of such as rest member is that the component cannot be designed with an arbitrary extension in a horizontal direction which is substantially perpendicular to the horizontal movement direction of the building element. If the extension of the rest member in said direction is to large this implies that the rest member will stand in the way of for example window shades, and further the wall structure will not fulfil the aesthetical requirements of such a wall. The limited extension of the rest member implies in turns that the rest member is able to support the building element only during a very small part of the pivot motion. Because of allowances of the components comprised and variations of the position of the rest member and/or the first suspension arrangement when being assembled, it may occur that the pivoting means is not in the intended position relative to the locking mechanism during pivoting the building element. This may imply that the building element is damaged during pivoting thereof. The limited extension of the rest member may also result in that the building element does not have support for a sufficiently long time to enable the locking mechanism to effect the locking of the pivoting means, which results in that the building element will be pivoted without locking during a part of the pivot motion and thereby there is a risk that the building element will be tilted. This is especially apparent when using wide building elements, i.e. such elements which have a relatively large extension in the horizontal movement direction of the building element.

THE OBJECT OF THE INVENTION AND SUMMARY OF THE INVENTION

The first object of the invention is to provide a device of the type defined by way of introduction for forming a displaceable wall structure, in which device at least some of the discussed drawbacks of such previously known devices has been reduced to a substantial extent.

The first object is achieved by providing a device for forming a displaceable wall.

A second object of the invention is to provide a method of the type defined by way of introduction for locking a building element, by which method at least some of the drawbacks of such previously known methods has been reduced to a substantial extent.

The second object is achieved by providing a method for locking a building element.

By means of a first component arranged on the building element between the first suspension arrangement and the pivot axis of the pivoting means, and a second component by which the first component is arranged to cooperate with to temporarily lock the pivoting means in said predetermined position against horizontal movement during at least a first part of the pivot motion of the building element, the distance in a horizontal direction which is substantially perpendicular to the horizontal movement direction of the building element and available for applying a rest member of some kind, and which distance for the reasons mentioned above is limited, may be used in a more optimal way. By means of the first and the second components the building element may be locked by a member which is independent of the first suspension arrangement and by arranging the first component between the first suspension arrangement and the pivot axis thus, the first component will be situated closer to the pivot axis than the first suspension arrangement. The closer to the pivot axis the locking step is performed, the better utilization of the available distance will be obtained, since for a given distance it is required that the building element is pivoted more to obtain that a point of the building element situated closer to the pivot axis will move said distance than what is the case for a point of the building element situated further away from the pivot axis. A larger pivot motion of the building element during which pivot motion the first and the second components may cooperate with each other implies a greater probability that the locking mechanism will be able to lock the pivoting means before the locking step of the building element by means of the first and the second components has ceased.

Further advantages of the invention appear from the following description and the dependent claims.

SHORT DESCRIPTION OF THE DRAWINGS

In the drawings

Figure 2:
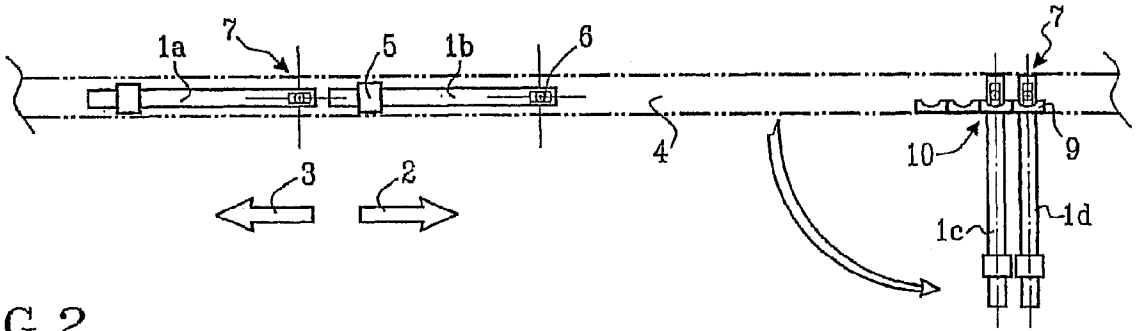
Figure 3A:
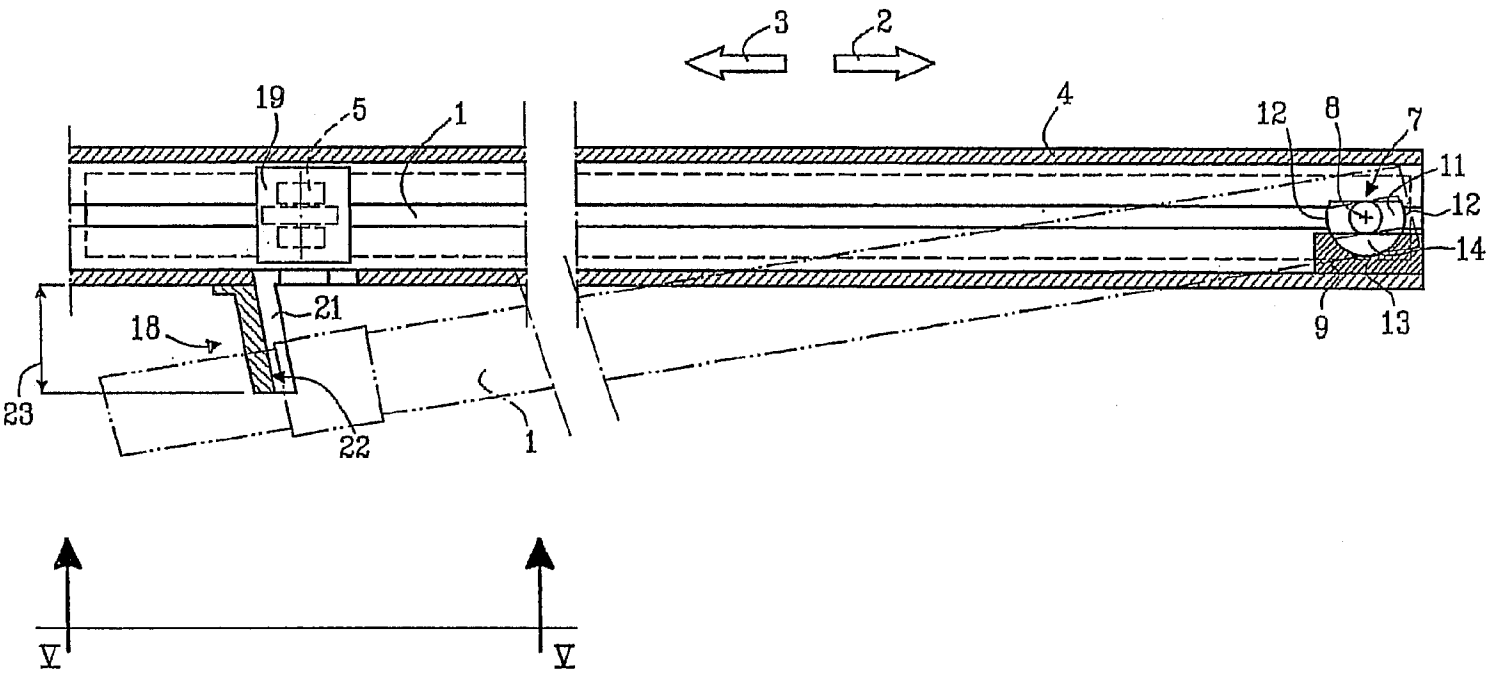
Figure 3B:
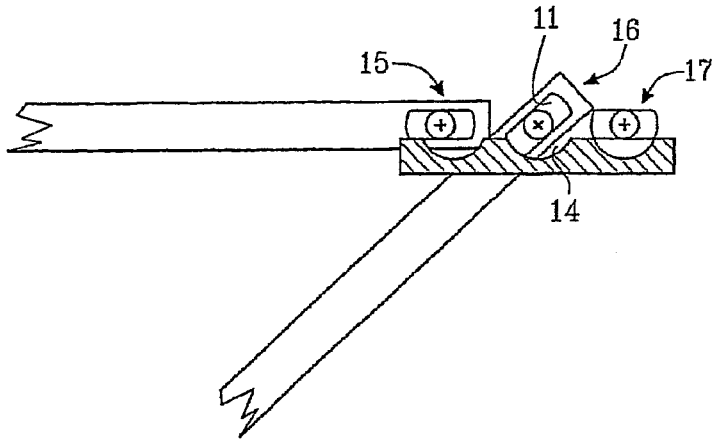
Figure 5:
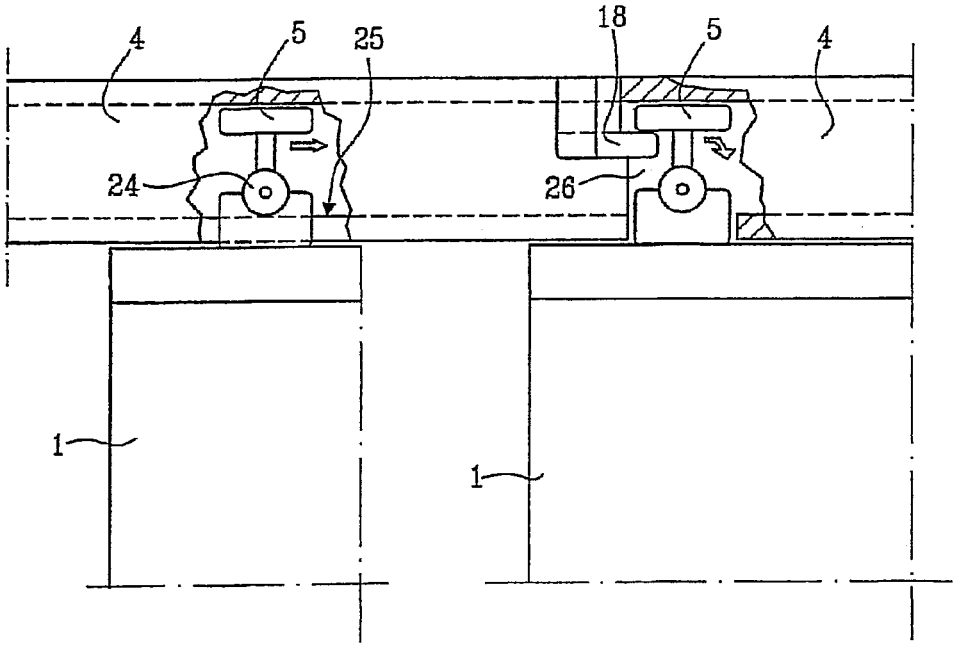
Figure 4:
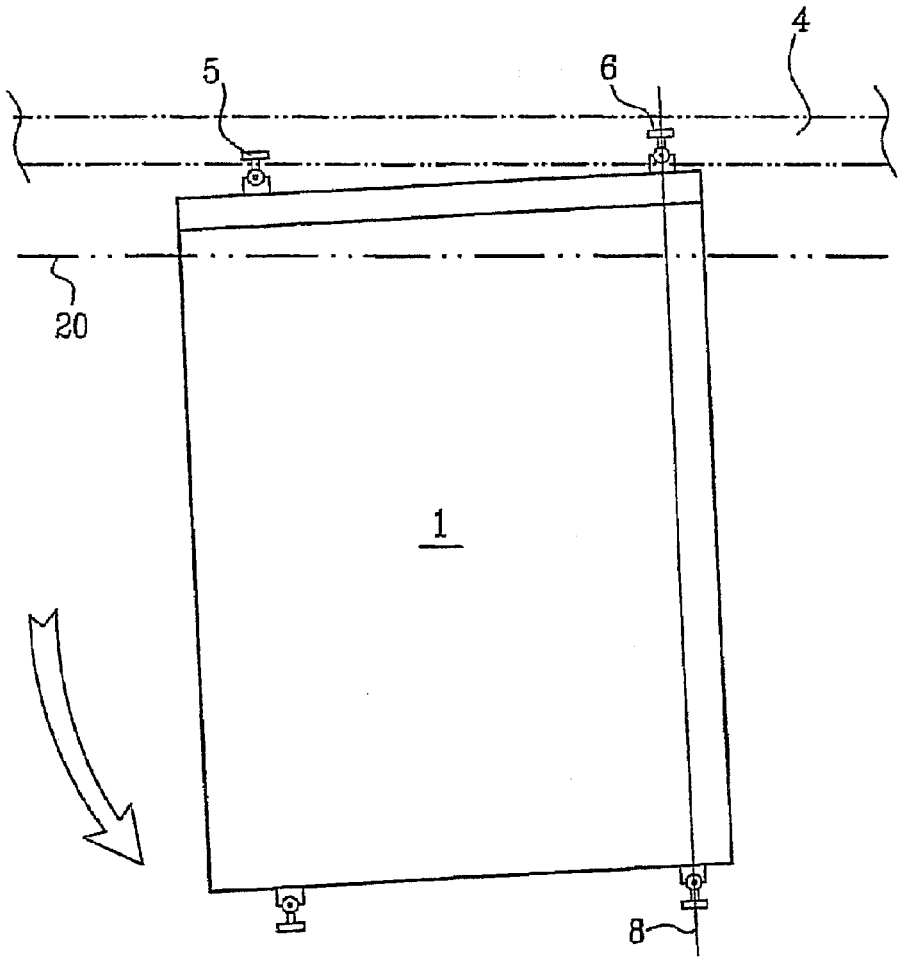
Figure 6:
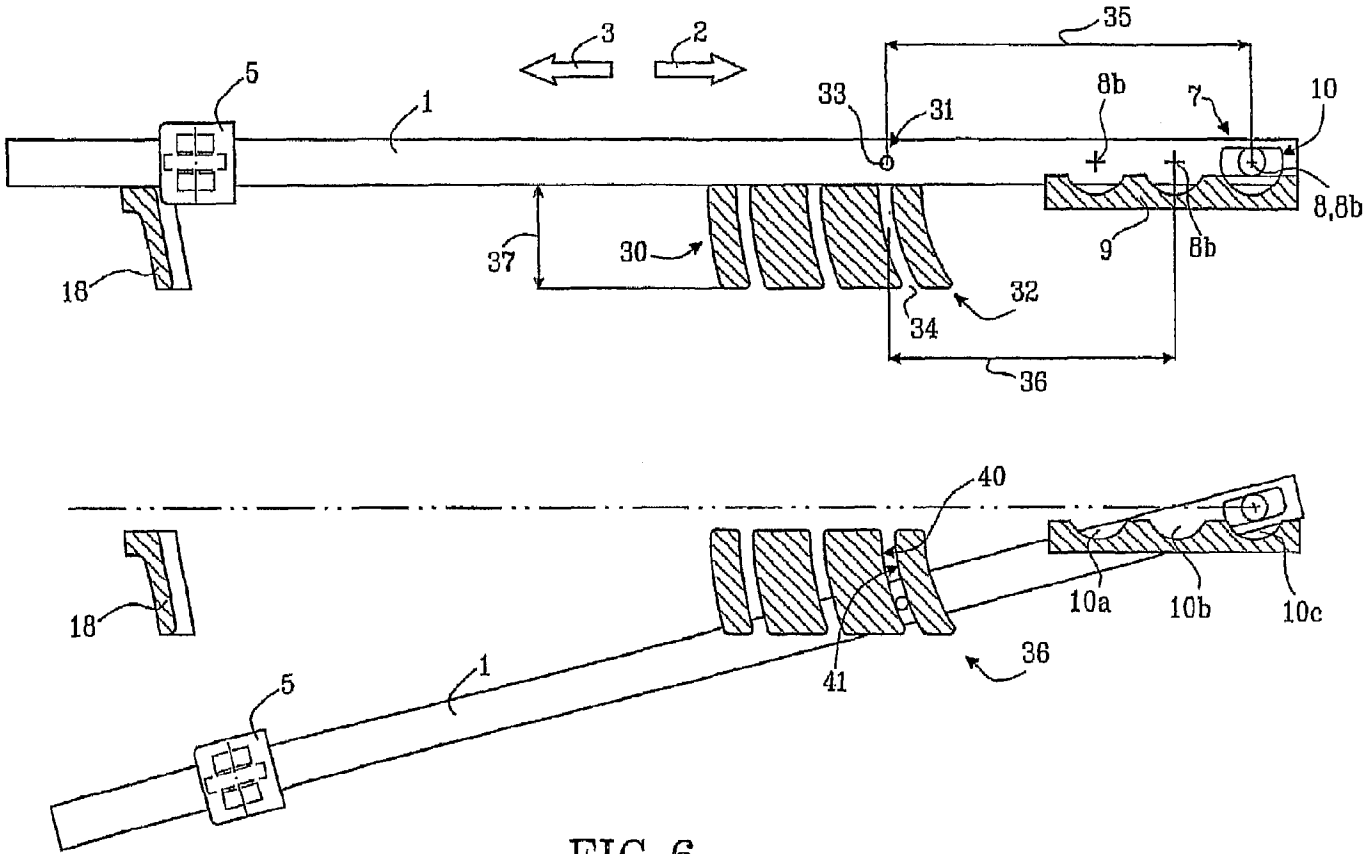
Figure 7:
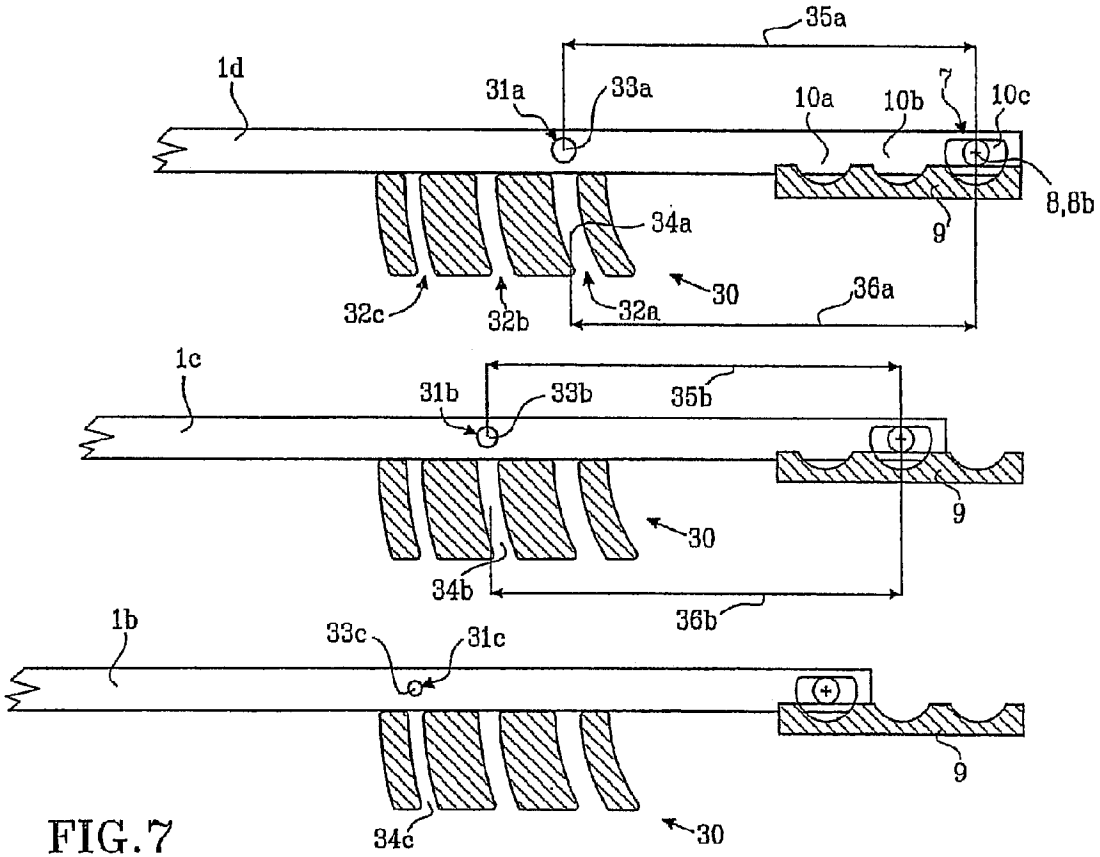
Figure 8B:
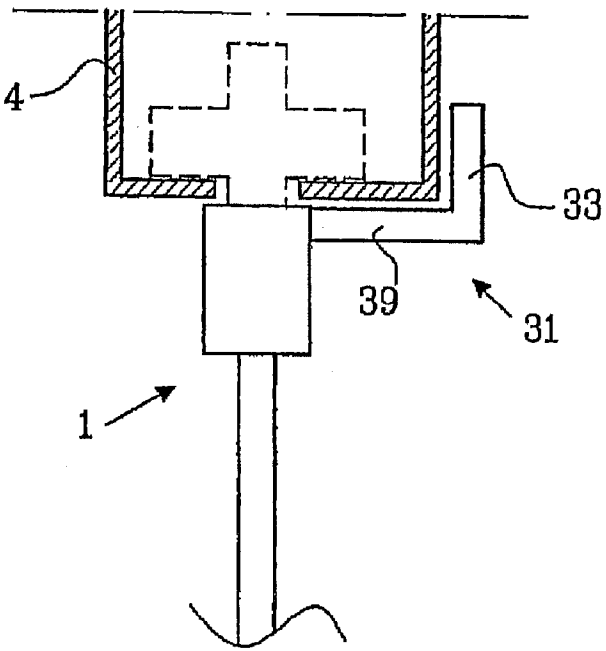
Figure 8A:
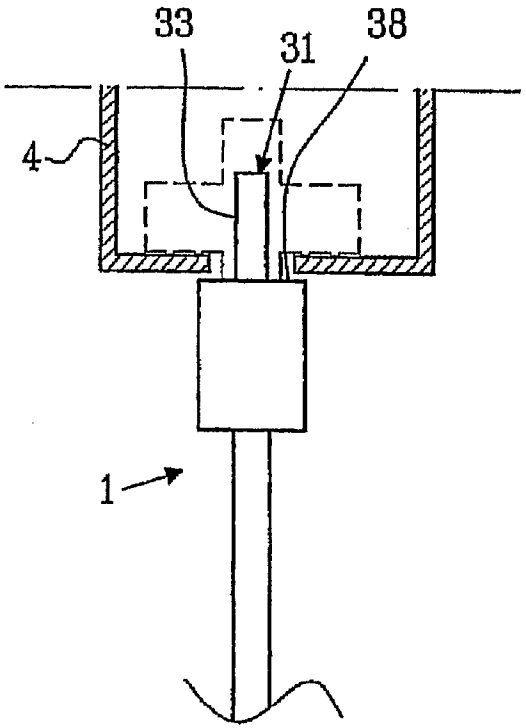

FIG. 1 is a schematic front view illustrating a device comprising a number of building elements for forming a displaceable wall structure, FIG. 2 is a view from above of the wall structure according to FIG. 1, FIG. 3*a* is a view from above of a device according to prior art having a building element provided with a pivoting means cooperating with a locking mechanism, FIG. 3*b* is a schematic view from above of the building element according to FIG. 3 illustrating different positions for the building element relative to the locking mechanism, FIG. 4 is a schematic view illustrating a building element which has got into a position which differ from a given horizontal line because of insufficient support, FIG. 5 a side view of the device in FIG. 3*a*, FIG. 6 a schematical view from above of a device having a locking member according to the invention, FIG. 7 a partial view of the device according to FIG. 6 illustrating different embodiments of the locking member according to the invention, FIG. 8*a* a cross-section view illustrating one embodiment of a first component of the locking member according to the invention, and FIG. 8*b* a variant of the first component according to FIG. 8*a*.

DETAILED DESCRIPTION OF PREFERRED EMBODIMENTS OF THE INVENTION

In FIGS. 1 and 2 a device for forming a displaceable wall structure which comprises four building elements 1*a*, 1*b*, 1*c*, 1*d* is schematically illustrated. FIG. 1 is a front view showing the building elements 1 placed side by side for achieving a wall, such as for example a wall for glazing in a balcony. Each building element 1 is displaceable forward 2 and backward 3 along a support unit 4. For this purpose each building element 1 is provided with a first 5 and a second 6 arrangement for suspension of the building element 1 from the support unit 4 for substantially horizontal movement of the building element 1 forward 2 and backward 3 along the support unit 4. The first 5 and second 6 suspension arrangement of respective building element 1 is arranged spaced from each other along the extension of the building element 1 parallel to said substantially horizontal movement direction 2, 3 when the arrangements cooperate with the support unit 4.

The support unit 4 may for example include a rail and the suspension arrangements 5, 6 of the building element may include wheels so that the building elements are displaceable by rolling along the support unit via the wheels. Other structures, for example such where the building element is arranged to slide instead of roll relative to the support unit and/or where the support unit has a rail or similar for supporting the building element from below at the lower edge thereof, are also possible within the scope of the invention.

In the example illustrated in FIGS. 1 and 2, the fourth building element 1*d* could however be fixedly arranged in such a way that the building element is not horizontal displaceable along the support unit as the other building elements 1*a*, 1*b*, 1*c*. In such a case, the fourth building element 1*d* could be the building element of the wall structure which is situated furthest in the forward direction 2 and at which building element the other building elements are intended to be stacked.

In FIG. 2 the device according to FIG. 1 is illustrated in a view from above. It is shown how the building element 1*d* furthest to right in the figure has been pivoted approximately 90° relative to the horizontal movement direction 2, 3 and the next element 1*c* has been displaced in the forward direction 2 in direction towards this element 1*d* to a position along the support unit in which the element in the same way has been pivoted substantially 90°. For providing the pivot motion all building elements 1 comprise a means 7 for pivoting the building element 1 about a substantially vertical pivot axis 8. Thus, the building elements 1 are pivotable in such a way that they can be stacked side by side to move the wall away and open up to the area inside the wall.

Certainly, the pivoting means 7 may be designed so that a desired size of the pivot motion of the building element 1 is obtained. The building element 1 may be arranged for a pivot motion in the interval ±0-360°, preferably in the interval 0-150°. In the example illustrated the building elements 1 are pivotable at least 90° relative to the direction in which the building elements are horizontal displaceable along the support unit. The pivot axis 8 of the pivoting means 7 is suitably arranged at the second suspension arrangement 6, i.e. the arrangement which is furthest in the forward direction 2, so that this is arranged to remain at the support unit 4, whereas the first suspension arrangement 5 is pivotable away from and toward the support unit 4, when pivoting the building element 1 about the pivot axis 8. For securing that the building element 1 remains in its position relative to the support unit 4, both as regards movement along the horizontal movement direction 2, 3 and as regards a given horizontal line, during the main part of the pivot motion of the building element 1, the device is provided with a mechanism 9 cooperating with the pivoting means 7 for locking the pivoting means 7 in a predetermined position 10, which position is situated at the support unit 4 along the horizontal movement direction 2, 3, against horizontal movement during pivoting the building element 1 about the pivot axis 8. In this connection, the locking mechanism 9 provides for that the building element 1 does not be unintentionally displaced in the backward direction 3 during pivoting the building element 1 and that the building element does not "be slanted" when the element does not have support via the first suspension arrangement 5 which during pivoting of the building element 1 leaves the support unit 4.

In FIGS. 3*a* and 3*b* one of the building elements 1 comprising such a pivoting means 7, and the locking mechanism 9 are illustrated. The pivoting means 7 has a plate 11 which in the both ends 12 thereof has a circular arc-shaped appearance to fit together with a corresponding circular arc 13 of the locking mechanism 9. During pivoting the building element 1 the building element as well as the plate 11 are arranged to pivot about the pivot axis 8 and thereby engage a groove 14 of the locking mechanism 9, which groove 14 has the current circular arc shape 13. When the plate 11 is in engagement with the groove 14 of the locking mechanism the building element 1 is secured against unintentionally horizontal movement, at least in the backward direction 3. Three different positions for a building element are schematically shown in FIG. 3*b*. In a first position 15 the building element is not positioned relative to the locking mechanism 9 and a pivot motion of the building element 1 from this position would in the worst case imply that the suspension of the building element is damaged. In a second position 16, a certain pivot motion of the building element has been performed and the plate 11 is engaged with the groove 14 of the locking mechanism 9. In this position the building element is locked against horizontal movement and the building element may instead be pivoted about the pivot axis 8. Finally, the pivoting means 7 of the building element is illustrated in a third position 17 in which the building element is situated so that it may neither be moved horizontal along the support unit 4, nor be pivoted about the pivot axis 8.

The device in FIG. 3*a* is designed in accordance with prior art. The device comprises a rest member 18 and the rest member 18 is as usual situated in one end of the building element 1 for cooperating with the first suspension arrangement 5 during an initial part of the pivot motion of the building element 1. The rest member 18, which may be for example a plate or rail or other bracing support against which a part 19 of the first suspension arrangement 5 rests, may be used for supporting the building element 1 from below and from the side for the purpose of trying to secure that the building element 1 remains in an upright position, i.e. not being tilted relative to a horizontal line or by other words "is slanted", and that the building element 1 neither is moved in the backward direction 3 during the initial part of the pivot motion, before the locking mechanism 9 is able to provide for locking the pivoting means 7. A building element, which is not parallel to the horizontal line 20 because support has been missed during the pivot motion, is illustrated in FIG. 4. For this purpose, the rest member 18 may have a support surface 21 supporting the building element from below and a support surface 22 supporting the building element 1 from the side. When pivoting the building element 1 a part of the first suspension arrangement 5 will initially remain in contact with the rest member 18.

However, such as previously described the extension 23 of the rest member 18 allowed in a horizontal direction, which is substantially perpendicular to the horizontal movement direction 2, 3 of the building element, is limited. If the extension 23 of the rest member 18 is too long this will cause the rest member 18 to stand in the way for other equipment such as for example window shades, and that the wall structure does not fulfil the aesthetical requirements thereof. The limited extension of the rest member 18 implies in turn that it is able to provide support for the building element 1 only during a very small part of the pivot motion. Because of allowances of the components comprised and variations of the position of the rest member 18 and/or the first suspension arrangement 5 when assembled it may occur that the pivoting means 7 does not be in the intended position 10 relative to the locking mechanism 9 during pivoting the building element 1. This may imply that the building element is damaged when pivoting thereof. The limited extension 23 of the rest member 18 may also result in that the building element 1 does not receive support for a sufficiently long time for enabling the locking mechanism 9 to accomplish the locking of the pivoting means 7, which results in that the building element 1 will be pivoted without being locked during a part of the pivot motion. This is especially apparent in the use of wide building elements 1, i.e. such elements which have relatively large extension in the horizontal movement direction of the building element.

In FIG. 5 a part of the device according to FIG. 3*a* is shown in a front view. The building element 1 with the first suspension arrangement 5 thereof. Is illustrated in two different positions along the support unit 4. To the left in FIG. 5 it is exemplified how one or more wheels 24 of the suspension arrangement may be arranged to roll relative to a surface 25 of the support unit 4 for achieving the horizontal movement of the building element 1 along the support unit 4. To the right in FIG. 5 the first suspension arrangement 5 is in a position where the building element 1 may be pivoted outwards and the first suspension arrangement 5 may leave the support unit 4 via an opening 26 in the support unit 4 and instead be brought into contact with the rest member 18. Although not illustrated, certainly also the second suspension arrangement 6 may be designed in a similar way and be combined with the pivoting means 7 so that the pivot axis 8 extends substantially central through the suspension arrangement 6 so that this suspension arrangement is arranged to remain in contact with the support unit 4 when pivoting the building element 1.

In FIG. 6 a device for forming a displaceable wall structure of building elements 1 is shown, which device comprises a member 30 according to the invention having a first component 31 which is arranged on the building element 1 between the first suspension arrangement 5 and the pivot axis 8 of the pivoting means 7 and a second component 32 which preferably is fixedly arranged relative to the locking mechanism 9 and by which the first component 31 is arranged to cooperate with for locking the pivoting means 7 in said predetermined position 10 against horizontal movement during at least a first part of the pivoting motion of the building element 1. Preferably, the locking member 30 is arranged to temporarily lock the pivoting means 7 during said first part of the pivot motion, i.e. during substantially the phase when the first suspension arrangement 5 leaves the support unit 4 and during the part of the pivot motion course which follows directly thereafter.

In the illustrated embodiment the locking member 30 is arranged to lock the pivoting means 7 against horizontal movement from said predetermined position 10, in both the backward direction 3 and the forward direction 2. The first component 31 of the locking member 30 is preferably a pin 33, having for example a circular cross-section, arranged on the building element 1 and arranged to run in a slit 34 of the second component 32 when pivoting the building element 1. In this connection the second component 32 is provided with two surfaces 40, 41 for guiding the pin 33 in the desired direction. The first component 31 is preferably fixedly arranged on the building element 1 at a certain distance 35 from the pivot axis 8 of the pivoting means 7 and the second component 32 is preferably fixedly arranged relative to the locking mechanism 9 at a certain distance 36 in the backward direction 3 from the position of the locking mechanism 9 in which position the pivot axis 8 of the pivoting means 7 is situated when the pivoting means 7 being in said predetermined position 10. By other words, the second component 32 is preferably fixedly arranged relative to the locking mechanism 9 at a certain distance 36 in the backward direction 3 from the position of a corresponding pivot axis 8*b* of the locking mechanism 9. Both the pivoting means 7 and the locking mechanism 9 may be considered to have a vertical pivot axis 8, 8*b* and when the building element 1 is placed so that these axes substantially coincide the pivoting means 7 will be in said predetermined position 10 and the building element 1 may be pivoted. By provision of the above described certain distances 35, 36 between the first component 31 and the pivot axis 8 of the pivoting means 7 and between the second component 32 and the pivot axis 8*b* of the locking mechanism 9, respectively, is it secured that the building element 1 is arranged in the right position 10, i.e. that the pivot axes 8, 8*b* coincide, when the building element is to be pivoted.

The silt 34 of the second component 32 has a circular arc-shaped extension for enabling movement of the pin 33 along the slit 34 when pivoting the building element 1. To obtain locking by means of the locking member 30 during as large part as possible of the pivot motion course, for a certain allowed extension 37 of the second component 32, the first 31 and second 32 components should be arranged as close as possible to the pivot axis 8*b* of the locking mechanism 9. However, there may be other aspects which imply that the locking member 30 cannot be placed in the immediate vicinity of the pivot axis. The distance is suitably adapted to the used width of the building element and to the allowed extension 37 of the second component 32 in a horizontal direction which is substantially perpendicular to the horizontal movement direction 2, 3 of the building element 1.

It is clear from the lower partial figure in FIG. 6 illustrating the building element 1 in an outwardly pivoted position, that by locking member 30 according to the invention a locking by means of the first component 31 being in engagement with the second component 32 may be obtained in different phases of the pivot motion for which the conventional rest member 18 is not able to provide any support for the building element 1 and this is true without that the horizontal extension 37 of the second component 32 perpendicular to the horizontal movement direction 2, 3 exceeds the corresponding extension of the rest member 18. As a consequence, by the locking member 30 according to the invention it can be secured that the locking mechanism 9 is able to lock the pivoting means 7 before locking by means of the locking member 30 ceases in spite of that the device possibly has unfavourable allowances and/or that an unfavourable assembling of a possibly occurring conventional rest member 18 and the first suspension arrangement 5 relative to each other is present.

In a preferred embodiment of the invention the first component 31 is arranged so that the distance 35 between this component and the pivot axis 8 of the pivoting means 7 is less or equal to 0.9 times the distance between the first suspension arrangement 5 and the pivot axis 8 of the pivoting means. In other preferred embodiments of the invention the distance 35 between the first component 31 and the pivot axis 8 of the pivoting means 7 is less or equal to 0.75, suitably less or equal to 0.5 and preferably less or equal to 0.3, times the distance between the first suspension arrangement 5 and the pivot axis 8 of the pivoting means 7.

When using several building elements 1, which are stacked to each other such as illustrated in FIG. 2, the building elements will be able to be displaced different distances in the forward direction 2 because of the thickness of the building elements 1. By other words, same number of locking positions of the locking mechanism 9 as there are building elements 1 which are to be pivoted in such a position are required. In FIGS. 6 and 7 the locking mechanism 9 has three locking positions, 10*a*, 10*b*, 10*c* for a corresponding number of building elements and for locking the pivoting means 7 of respective building element in a respective said predetermined position 10 against horizontal movement.

In FIG. 7 the device has three building elements and three locking positions 10*a*, 10*b*, 10*c* of the locking mechanism 9. Certainly, the different partial figures are only intended to show respective building element at the respective locking position of the locking mechanism 9 more in detail, which means that in reality the locking mechanism 9 is one and the same locking mechanism in all of the partial figures and in the same way the locking member 30 is one and the same locking member which is depicted in the different partial figures. However, it should be emphasized that in another embodiment it is possible to arrange several locking mechanisms having a desired number of locking positions and/or several locking members along the support unit if so is desired.

The locking member 30 comprises one said second component 32 for respective first component 31 of the building element 1 and the first component 31 of respective building element is arranged to cooperate with one respective said second component 32 to temporarily lock the pivoting means 7 of respective building element 1.

In the case the device such as illustrated in FIGS. 3*a* and 5 has a first suspension arrangement, the wheels of which are situated inside the support unit, and the support unit is provided with only one opening which requires that the first suspension arrangement is placed in a certain position to be able to leave the support unit when pivoting the building element 1, it is required that the distance between the first suspension arrangement and the pivot axis of the pivoting means is greatest in the foremost building element in the forward direction and that the corresponding distances decrease with a length corresponding to the distance between two locking positions of the locking mechanism for respective building element thereafter. This in turn results in that the respective building element may be pivoted in only one certain locking position of the locking mechanism on condition that respective first suspension arrangement is correctly assembled.

However, if the first suspension arrangement instead comprises wheels which are arranged outside the support unit and/or the support unit has a relatively large opening, then it will be possible to pivot a building element when being in a non-intended locking position. To avoid that a building element 1 in such a case is placed in a non-intended locking position of the locking mechanism 9 by that the first component 31 cooperates with a non-intended second component 32 said first and second components 31, 32 are suitably designed to form predetermined pairs 31*a*, 32*a*; 31*b*, 32*b*; 31*c*, 32*c* whereby respective first component is able to cooperate with only one respective said second component. To provide for this the cylindrical pins 33*a*, 33*b*, 33*c* and the corresponding silts 34*a*, 34*b*, 34*c* may for example be designed with different diameters/slit width, and possibly be arranged in a certain sequence along the horizontal movement direction 2, 3, for example so that the pin 33*a* of an arbitrary building element 1*d* has larger diameter than the pin of the next following building element 1*c*, so that a certain pin only fits in a certain slit.

In FIGS. 8*a* and 8*b* different embodiments of the first component 31 are illustrated in cross-section views of the support unit 4 and a part of one building element 1. In FIG. 8*a* the first component 31 is a pin 33 arranged on the building element 1. The pin 33 extends in substantially the vertical direction upwards from the upper side 38 of the building element 1. This design of the first component 31 substantially corresponds to what is shown in FIGS. 6 and 7. However, it is possible within the scope of the invention to design the locking member 30 in many different ways. In FIG. 8*b* the first component 31 of the locking member 30 has a part 39 which extends latterly from the building element 1 and a pin 33 which in the same way as the pin in FIG. 8*a* extends upwards in the vertical direction. The latter embodiment has the advantage that the first component 31 is arranged outside the support unit 4 and thus, the support unit 4 does not need to be designed with an opening/openings for enabling the pin to pivot together with the building element and to leave the support unit 4 when pivoting the building element. Another advantage is the fact that for a given position of the corresponding second component less pivot motion of the building element 1 will be required before the first component 31 engages the second component of the locking member 30.

However it should be emphasized that in most cases it is favourable that the first and the second components are located close to each other before the building element is to be pivoted, i.e. when the building element is positioned along the horizontal movement direction with the pivoting means in the predetermined locking position, so as to bring the first and the second components to engage each other as soon as possible when pivoting the building element. Certainly, this can be provided for in different ways by adapting the design of the first component and/or the design of the second component and the positions of these components relative to each other.

In a variant of a locking member for example the first component could be a pin with an elongated cross-section having a shape substantially corresponding to the shape of the slit of the second component, which would give larger contact surfaces between the limiting surfaces of the pin and the slit.

It should be stressed that the invention is applicable also to already installed displaceable walls of the current type. The building elements of such a wall structure may afterwards be provided with the locking member according to the invention comprising a first and a second component. Thus, the patent application intends to also comprise a method for locking a building element 1 when such a building element is installed as well as for completion of a building element already installed. The method for locking a building element 1, which building element is provided with a first 5 and a second 6 arrangement for suspension of the building element 1 from a support unit 4 and for substantially horizontal movement of the building element forward 2 and backward 3 along the support unit 4, the first 5 and the second 6 suspension arrangements, when cooperating with the support unit 4, being arranged spaced from each other along the extension of the building element 1 parallel to said substantially horizontal movement direction 2, 3, and the building element has a means 7 for pivoting the building element about a substantially vertical pivot axis 8, comprises the use of a mechanism 9 cooperating with the pivoting means 7 for locking the pivoting means 7 in a predetermined position 10 against horizontal movement during pivoting the building element 1 about the pivot axis 8. The method further comprises the use of a member 30 according to the invention having a first component 31 which is arranged on the building element 1 between the first suspension arrangement 5 and the pivot axis 8 of the pivoting means 7 and a second component 32 by which the first component 31 is arranged to cooperate with, for locking the pivoting means 7 in said predetermined position 10 against horizontal movement during at least a first part of the pivot motion of the building element 1.

In a variant of the method this may be used for adjustment of a conventional rest member 18 and the first suspension arrangement 5 relative to each other with a greater accuracy then in a normal case. In this connection the building element 1 is adjusted into a position so that the first 31 and the second 32 component cooperate and thereafter a further component, such as the above mentioned rest member 18, for supporting the building element 1 from below in a direction which is substantially parallel with the direction of the pivot axis 8 and/or for locking the pivoting means 7 in said predetermined position 10 against horizontal movement, and the first suspension arrangement 5 are positioned relative to each other. This has the advantage that during assembling the rest member 18 and/or the first suspension arrangement 5 or adjustment of the rest member 18 and the first suspension arrangement 5 relative to each other, thanks to the locking member 30 according to the invention the building element 1 is securely positioned in the predetermined position 10 in which the pivot motion is intended to be accomplished.

The invention also relates to a balcony glazing-in system comprising a device according to the invention installed at a balcony for establishing at least one displaceable and removable glass wall arranged along at least one part of the circumference of the balcony.

The device according to the invention works as follows: When the wall structure be moved away the building element 1 being the foremost element in the forward direction 2 is displaced along the support unit 4 to the predetermined locking position 10 of the locking mechanism 9 for the building element. Thereafter the building element is pivoted to the desired position while the locking member 30 according to the invention provides for that the building element remains in the locking position during an initial phase of the pivot motion until the locking mechanism 9 is able to lock the building element 1 against horizontal movement from the predetermined locking position 10. Thereafter the next building element is displaced to its predetermined locking position of the locking mechanism and is pivoted in a way so that it will be positioned at the foremost building element. The procedure is then repeated for an arbitrary number of building elements so that the area enclosed by means of the wall of building elements is opened up to the desired extent. When re-establishing the wall the latest stacked building element is pivoted back to a position in which the both suspension arrangements 5, 6 of the building element 1 cooperate with the support unit 4 and thereafter the building element 1 is displaced in the backward direction 3 to the desired position. The procedure is then repeated in proper order for each building element until the desired wall is established again.

There are of course other ways than the ways described in this application to design the device according to the invention, and to perform the method according to invention, within the frame of the idea of the invention and it should be emphasized that the invention is only limited to the scope of protection which is defined by the accompanying claims. For example the first component in the shape of a pin could be designed with a head, i.e. a portion having a larger diameter than the other part of the pin and the width of the slit, arranged above the slit so that the pin locks the building element against movement downward in the vertical direction through the abutment of the head against the second component.

The invention claimed is:

1. A device for forming a displaceable wall structure, comprising one or more building elements each provided with a first and a second suspension arrangement for suspension of the building element from a support unit and for substantially horizontal movement of the building element in a forward and backward direction along the support unit, the first and the second suspension arrangements, when cooperating with the support unit, being arranged spaced from each other along an extension of the building element parallel to said substantially horizontal movement direction, and the building element has a pivoting means defining a substantially vertical pivot axis about which said building element is arranged to pivot, said first suspension arrangement being pivotable away from and towards the support unit, during pivoting of the building element about the pivot axis, said device further being provided with a rest member adapted to support said building element during an initial pivot motion of said building element, and the device further comprising a locking mechanism cooperating with the pivoting means to thereby lock the pivoting means in a predetermined position against horizontal movement during pivoting of the building element about the pivot axis, wherein the device comprises a locking member having a first component arranged on the building element between the first suspension arrangement and the pivot axis of the pivoting means, and a second component comprising a surface by which the first component is arranged to be guided and to cooperate to thereby lock the pivoting means in said predetermined position against horizontal movement in a direction from said pivoting means towards said first suspension arrangement during at least a first part of the pivot motion of the building element, and the cooperation between said first component and said second component constitutes the locking of the pivoting means during at least a first part of the pivot motion of the building element.

2. A device according to claim 1, wherein the pivot axis of the pivoting means is arranged at the second suspension arrangement so that the second suspension arrangement is arranged to retain at the support unit, during pivoting the building element about the pivot axis.

3. A device according to claim 1, wherein said second component of said locking mechanism comprises a slit or an arcuate surface, by which the first component is arranged to be guided.

4. A device according to claim 1, wherein the locking member is arranged to lock the pivoting means against horizontal movement a direction from said first suspension arrangement towards said pivoting means from said predetermined position.

5. A device according to claim 1, wherein the first component is fixedly arranged on the building element at a certain distance from the pivot axis of the pivoting means.

6. A device according to claim 1, wherein the second component is fixedly arranged relative to the locking mechanism at a certain distance in a backward direction from the position of the locking mechanism in which position the pivot axis of the pivoting means is situated when the pivoting means being in said predetermined position.

7. A device according to claim 1, wherein the first component is arranged so that the distance between said first component and the pivot axis of the pivoting means is less or equal to 0.9 times the distance between the first suspension arrangement and the pivot axis of the pivoting means.

8. A device according to claim 1, wherein the first component is arranged so that the distance between said first component and the pivot axis of the pivoting means is less or equal to 0.75 times the distance between the first suspension arrangement and the pivot axis of the pivoting means.

9. A device according to claim 1, wherein the first component is arranged so that the distance between said first component and the pivot axis of the pivoting means is less or equal to 0.5 times the distance between the first suspension arrangement and the pivot axis of the pivoting means.

10. A device according to claim 1, wherein the first component is arranged so that the distance between said first component and the pivot axis of the pivoting means is less or equal to 0.3 times the distance between the first suspension arrangement and the pivot axis of the pivoting means.

11. A device according to claim 1, wherein the first component is a pin.

12. A device according to claim 1, wherein the second component has a slit in which the first component is arranged to run during pivoting the building element.

13. A device according to claim 1, wherein said device comprises several building elements and the locking mechanism has a corresponding number of locking positions to thereby lock the pivoting means of respective building element in a respective said predetermined position against horizontal movement.

14. A device according to claim 13, wherein the locking member comprises several of said second component and the first component of respective building element is arranged to cooperate with a respective said second component to thereby lock the pivoting means of respective building element.

15. A device according to claim 14, wherein said first and second components are arranged in a way forming predetermined pairs whereby respective first component is able to cooperate with only one respective said second component.

16. A device according to claim 1, wherein said device comprises a rest member to thereby lock the pivoting means via the first suspension arrangement in said predetermined position against horizontal movement in the backward direction.

17. A device according to claim 16, wherein said rest member supports the building element from below via the first suspension arrangement in a direction which is substantially parallel to the direction of the pivot axis.

18. A device according to claim 16, wherein said device comprises a rest member to thereby support the building element from below via the first suspension arrangement in a direction which is substantially parallel to the direction of the pivot axis.

19. The device of claim 1, wherein the device for forming the displaceable wall structure comprises one of a, glass wall of a balcony, terrace, and veranda.

20. A device according to claim 1, wherein said device forms a balcony glazing-in system.

* * * * *